US007784434B2

(12) United States Patent
Gelderloos

(10) Patent No.: US 7,784,434 B2
(45) Date of Patent: Aug. 31, 2010

(54) HEAT EXCHANGE ELEMENT AND HEATING SYSTEM PROVIDED WITH SUCH HEAT EXCHANGE ELEMENT

(75) Inventor: Pouwel Jelte Gelderloos, Ugchelen (NL)

(73) Assignee: Remeha B.V., Apeldoorn (NL)

( * ) Notice: Subject to any disclaimer, the term of this patent is extended or adjusted under 35 U.S.C. 154(b) by 218 days.

(21) Appl. No.: 11/558,323

(22) Filed: Nov. 9, 2006

(65) Prior Publication Data

US 2008/0110416 A1 May 15, 2008

(51) Int. Cl.
*F22B 23/06* (2006.01)

(52) U.S. Cl. ..... 122/367.1; 122/367.3; 165/80.4

(58) Field of Classification Search ..... 122/18.1, 122/31.1, 32, 33, 367.1, 367.3; 165/80.3, 165/80.4, 168–171, 185
See application file for complete search history.

(56) References Cited

U.S. PATENT DOCUMENTS 4,282,833 A * 8/1981 Giesen ..... 122/158
4,356,794 A * 11/1982 Bouman et al. ..... 122/158
5,829,514 A 11/1998 Smith et al.
6,401,669 B1 * 6/2002 Macgowan et al. ..... 122/448.1
6,647,932 B1 * 11/2003 Cui et al. ..... 122/33

FOREIGN PATENT DOCUMENTS

| | | | |
|---|---|---|---|
| DE | 4421671 | A1 | 1/1996 |
| EP | 0843135 | A1 | 5/1998 |
| EP | 0889292 | A1 | 1/1999 |
| FR | 2495744 | A | 6/1982 |
| GB | 2000268 | A | 1/1979 |

OTHER PUBLICATIONS

Search Report.

* cited by examiner

*Primary Examiner*—Gregory A Wilson
(74) *Attorney, Agent, or Firm*—Leydig, Voit & Mayer Ltd.

(57) ABSTRACT

The invention relates to a heat exchange element intended for a central heating boiler, which heat exchange element is designed as a monocasting from substantially aluminum, the heat exchange element being provided with walls which bound a water-carrying channel, and with at least one wall which bounds at least one flue gas draft to which a burner can be connected, at least one wall which bounds the at least one flue gas draft being water-cooled in that it also forms a boundary of the water-carrying channel, while one said at least one water-cooled wall is provided with heat exchanging surface enlarging pins and/or fins which extend in the respective flue gas draft, wherein the cross-sectional surface of a said pin and/or fin is smaller than 25 mm$^2$. The invention also relates to a central heating boiler provided with such a heat exchange element.

29 Claims, 4 Drawing Sheets

HEAT EXCHANGE ELEMENT AND HEATING SYSTEM PROVIDED WITH SUCH HEAT EXCHANGE ELEMENT

FIELD AND BACKGROUND OF THE INVENTION

The invention relates to a heat exchange element intended for use within a central heating boiler, the heat exchange element being designed as a monocasting from substantially aluminum, the heat exchange element being provided with walls which bound a water-carrying channel, and with at least one wall which bounds at least one flue gas draft to which a burner can be connected, at least one wall which bounds the at least one flue gas draft being water-cooled in that it also forms a boundary for the water-carrying channel, while one said at least one water-cooled wall is provided with heat exchanging surface enlarging pins and/or fins which extend in the respective flue gas draft.

Such a heat exchange element is disclosed in European patent application EP-A-0 889 292. The heat exchange element described therein is particularly intended for great output and is thereto provided with several flue gas drafts. However, prior thereto, applicant has marketed central heating boilers with heat exchange elements with a single flue gas draft. These heat exchange elements are known as type indications W21C Eco and W28C Eco.

The known heat exchange elements have a weight of approximately 0.4 kg/kW. For a heat exchange element of approximately 25 kW, which is a customary output for a normal house, the weight is therefore approximately 10 kg. Moreover, the known heat exchange element with such an output has a water-carrying channel with a content of approximately 2.1 liters. This is, inter alia, the result of the fact that with the known heat exchange elements, the burner is completely surrounded by a heat exchanging surface and associated water channel.

Although the known heat exchange element is relatively small for a boiler with such an output, when the boiler is used for heating not only central heating water but also tap water, the efficiency can be improved still further, and a still more rapid heating of the tap water is desired.

To that end, the heat exchange element of the type described in the opening paragraph is characterized in that the cross-sectional surface of a pin and/or fin mentioned is smaller than 25 $mm^2$.

Previously, it was generally accepted that it was not possible to utilize pins and/or fins with such a small cross-sectional surface, because the pins and/or fins had to have a length of at least 25 mm. This requirement arises from a need for the flue gas draft to have a particular width for discharging sufficient flue gas and because this width is to be completely filled with the heat exchanging surface enlarging pins and/or fins. Pins with such a length need a large cross-sectional surface in view of casting technique requirements. The known pins, for instance, have a length of 25 mm and a diameter of 8 mm. When, with this length, a smaller diameter is chosen, the liquid aluminum solidifies during the casting process before the pin-forming cavity is completely filled. In casting practice, this phenomenon is known as cold flow.

It is noted that from U.S. Pat. No. 5,829,514, a so-called heat sink is known, which is provided with pins with a diameter leading to a cross-sectional surface in a range of the presently disclosed heat exchange element. The known pins have a diameter of 2 mm and, hence, a cross-sectional surface of 3.1 $mm^2$. A heat sink is a device utilized in electronic equipment, such as computers, for cooling electronic components accommodated therein. The heat sink shown in U.S. Pat. No. 5,829,514 comprises a first base plate and a number of pins extending away from this base plate, and a second base plate and a number of pins extending away from this second base plate. After having been manufactured separately in a casting process, the two plates are interconnected. The known heat sink is therefore not a monocasting. Based upon the diameters of the pins mentioned in the text, and the drawings, which are enlarged by a factor of three, the dimensions of the base plates are approximately 3.3*2.5 cm. The separate base plates with pins are releasing, and can therefore be manufactured through die-casting.

With die-casting, the mold is of metal and can be heated, so that the so-called cold flow occurs much less rapidly. Furthermore, the base plate is relatively thick so that virtually no cooling of casting material occurs. Optionally, with such a process, the liquid metal can be supplied under excess pressure. This is contrary to a heat exchange element for a central heating boiler. Firstly, the heat exchanger designed as monocasting is non-releasing. As a result, a mold and cores manufactured from sand, and which are lost after the casting process, have to be utilized. This excludes the possibility of casting under excess pressure. Furthermore, heating a sand cast mold is not possible. When casting a heat exchange element designed as monocasting, the liquid metal runs from one filling point, through the cavities for forming the thin-walled water channels, and thereafter flows into the cavities for forming the pins. Not only is the distance the liquid metal has to travel from the filling point to the pins much longer, because the walls bounding the water channels are thin the extent of cooling of the liquid metal is considerable—which has an adverse affect on the cold flow of the liquid metal in the pin forming cavities. The dimensions of exemplary embodiments of the present invention are in the range of, for instance, 20-50 cm, which is not comparable to the dimensions of the known heat sink.

Also, the freedom of choice of metal used for casting a central heating heat exchange element more limited than the freedom of choice for a heat sink. The central heating heat exchange element is used in an environment of flue gases and water vapor which leads to the formation of highly corrosive acids. With a heat sink air flow is involved. For a heat sink, high-flowing alloys can be selected that can be cast in a simple manner. Such alloys, due to their corrosion sensitivity, are not suitable for the manufacture of a central heating heat exchange element.

For the above reasons, a person of average skill in the field of central heating heat exchanges element design would not turn to the field of heat sinks for guidance in designing boiler heat exchange elements, and in any event such teachings would not suggest the present invention.

SUMMARY OF THE INVENTION

In accordance with embodiments of the present invention, the pins and/or fins within a heat exchange elements are shortened. Shortening the length of the heat exchange element pins to, for instance, 15 mm, allows for thinner pins and/or fins to be used without the risk of cold flow occurring during manufacture of the heat exchange element. The thinner pins have a greater surface-to-content ratio, so that their heat exchanging action is better with a smaller weight. The smaller cross-sectional surface of the pins and/or fins and the smaller length thereof result in the heat exchange element having a smaller weight. Instead of the 0.4 kg/kW, which is customary with known cast aluminum heat exchange elements, with a heat exchange element according to the invention, a value of 0.16 kg/kW can be achieved.

After switching on the burner, the heat exchange element will therefore, as a result of the more limited heat capacity thereof, heat up much more rapidly. In particular with sanitary water heating, that is, with tap water in use, this has the advantage that the convenience time, i.e. the time required for obtaining hot water from the tap, is considerably reduced. As the length of the pins and/or fins is smaller, also, the distance between the opposite walls provided with pins and/or fins is smaller. This results in a smaller cross-section of the flue gas draft which, in turn, leads to a higher flow velocity of the flue gases in the flue gas draft. In turn, a higher flow velocity leads to a higher heat transfer coefficient which, in turn, is favorable to the efficiency of the heat exchange element.

Another advantage of the pins and/or fins with the smaller cross-section is that, with the heat exchanging surface remaining the same, the global wall surface, i.e. the dimensions of the wall that bears the pins, can be considerably smaller. This therefore leads to a smaller surface to be cooled with water. As a result thereof, the water-carrying channel has a smaller content, which also leads to a smaller heat capacity of the heat exchange element.

According to a further aspect of the invention, the water content of the water-carrying channel is reduced by reducing to less than 10 mm (e.g., less than 8 mm) the distance between the wall which bounds, on the one side, the water-carrying channel and, on the other side, an outside of the heat exchange element, and the wall which bounds, on the one side, the water-carrying channel and, on the other side, the flue gas draft.

With such dimensions, a heat exchange element with an output of 28 kW is provided, with the water-carrying channel having a water content of 0.83 liter instead of the 2.1 liters for 25 kW that was customary heretofore. That is to say, 0.031/kW instead of 0.0841/kW which was customary heretofore. Also this dramatic reduction of water to be heated leads to a smaller heat capacity of the heat exchange element and, hence, to a quicker heating of the water contained in the heat exchange element.

A problem that may arise as a result of the smaller dimensions of the water-carrying channel is that the heat exchanging surface of the wall, that forms the boundary between the water-carrying channel and the flue gas draft on the water-side, is insufficient. According to a further aspect of the invention, this problem is addressed by providing the respective wall with water-side heat exchanging surface enlarging pins and/or fins. Notwithstanding the smaller global surface of the wall that bounds the water channel and the flue gas draft, sufficiently large heat exchanging surface is created as a result of the water-side pins/and or fins.

Efficiency is improved and tap water is more rapidly heated by a heating boiler provided with a central heating heat exchange element with a water-carrying channel, wherein the heating boiler is provided with a tap water heat exchanger that can be connected to an outlet of the water-carrying channel and an inlet of the water-carrying channel. A pump is provided for transporting the water through the central heating heat exchange element and the tap water heat exchanger. Furthermore, the central heating heat exchange element, the tap water heat exchanger, the burner the pump are adjusted such that, with tap water in use, the difference between the supply temperature, i.e. the temperature of the water coming from the water-carrying channel, that is led to the tap water heat exchanger, and the return water temperature, i.e. the temperature of the water coming from the tap water heat exchanger that is led into the inlet of the water-carrying channel, is higher than 25° C., and preferably higher than 30° C. This is preferably affected by maintaining the central heating side flow rate low.

As the return water temperature of the tap water heat exchanger is maintained much lower than was customary, the average temperature of the central heating heat exchange element is much lower. Previously, the supply water temperature was, for instance, 70° C., and the return water temperature 50° C. The average temperature across the central heating heat exchange element was therefore 60° C. When, with the supply water temperature remaining the same, the return water temperature is reduced to 30° C., the average temperature of the central heating heat exchange element is reduced to 50° C. When water is tapped, the central heating heat exchange element, which is maintained at approximately 30° C., need only heat up 20 degrees (to 50 degrees) instead of 30 degrees (to 60 degrees). This leads to a considerable acceleration of the required heating up time, so that hot tap water is available more rapidly. Because the return water temperature is lower, the flue gases cool down further so that increased condensation of the flue gases is possible. The further cooling of the flue gases results in better efficiency.

The lower return water temperature is achieved by reducing the central heating side flow rate, i.e. the flow rate in the water-carrying channel of the central heating heat exchange element. Also as a result of the limited water flow through the central heating heat exchange element, the heat transfer coefficient in the water-carrying channel decreases. As a result thereof, the presence of the water-side pins and/or fins mentioned hereinabove may be required for compensating for the lower heat transfer coefficient.

BRIEF DESCRIPTION OF THE DRAWINGS

The invention will presently be further described on the basis of an exemplary illustrated embodiment, with reference to the drawings wherein.

DETAILED DESCRIPTION OF THE DRAWINGS

Figure 1:
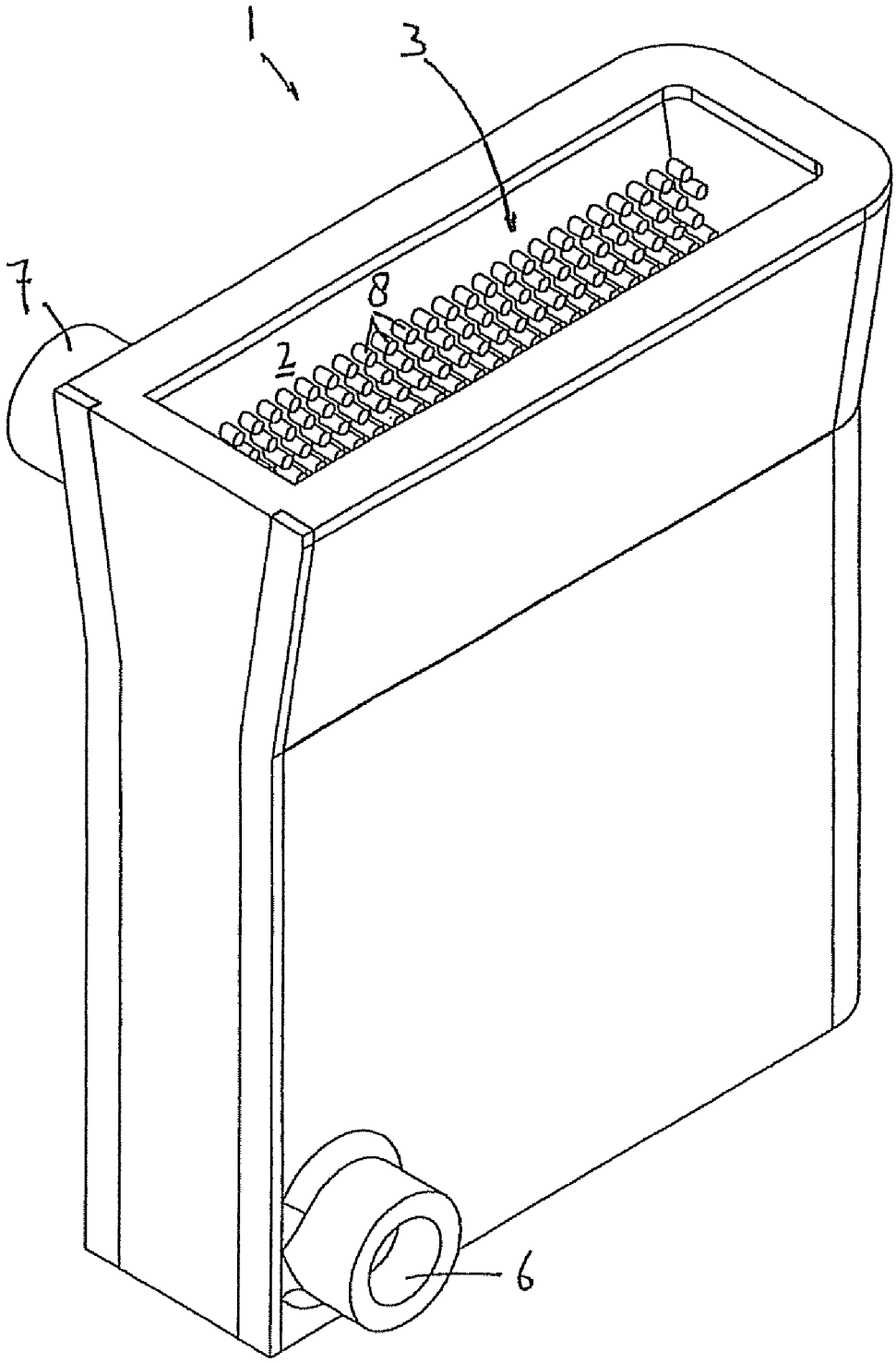
FIG. 1 shows a perspective view of a central heating heat exchange element according to the invention.
Figure 2:
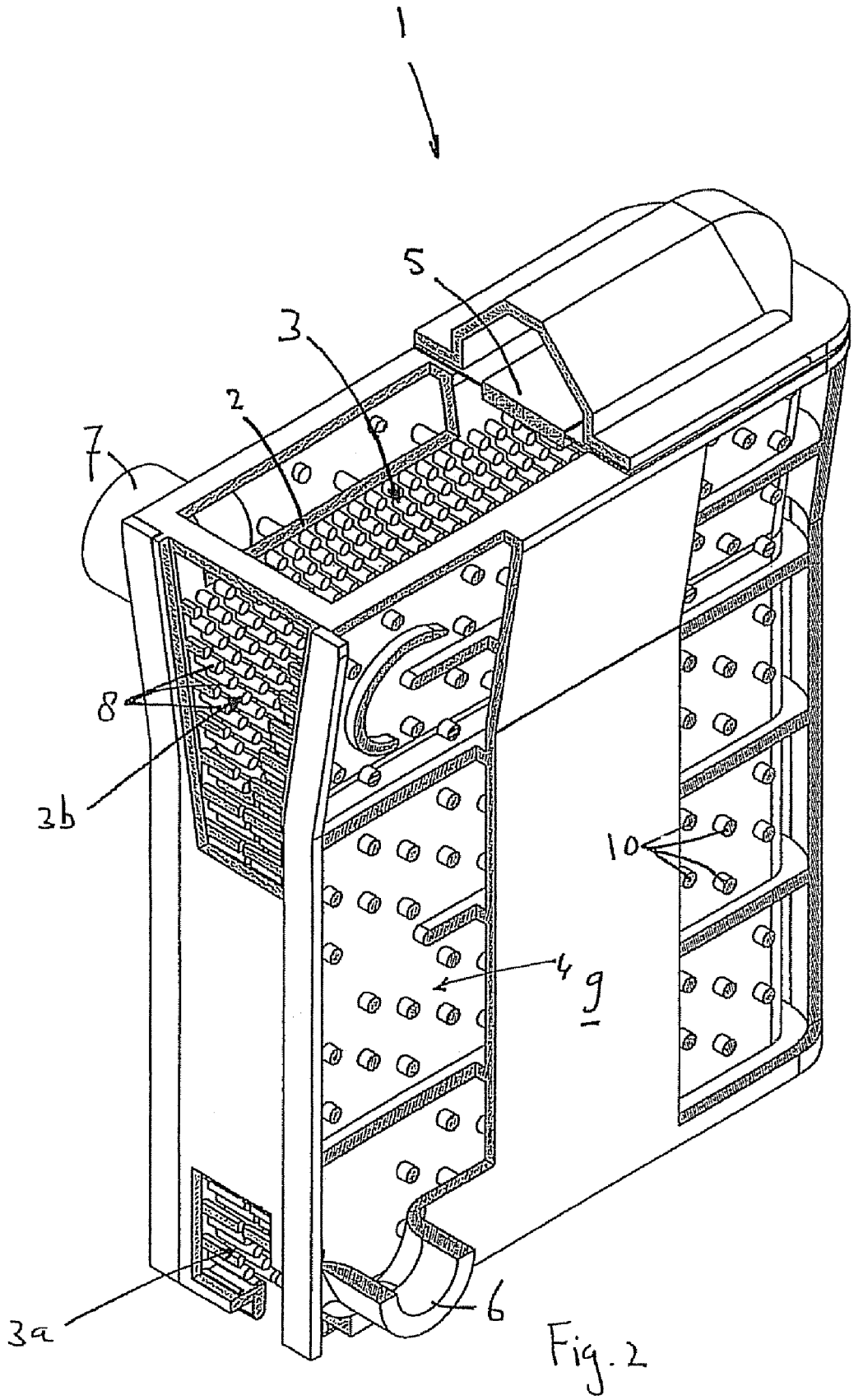
FIG. 2 shows a partly cutaway perspective view of the heat exchange element shown in FIG. 1.
Figure 3:
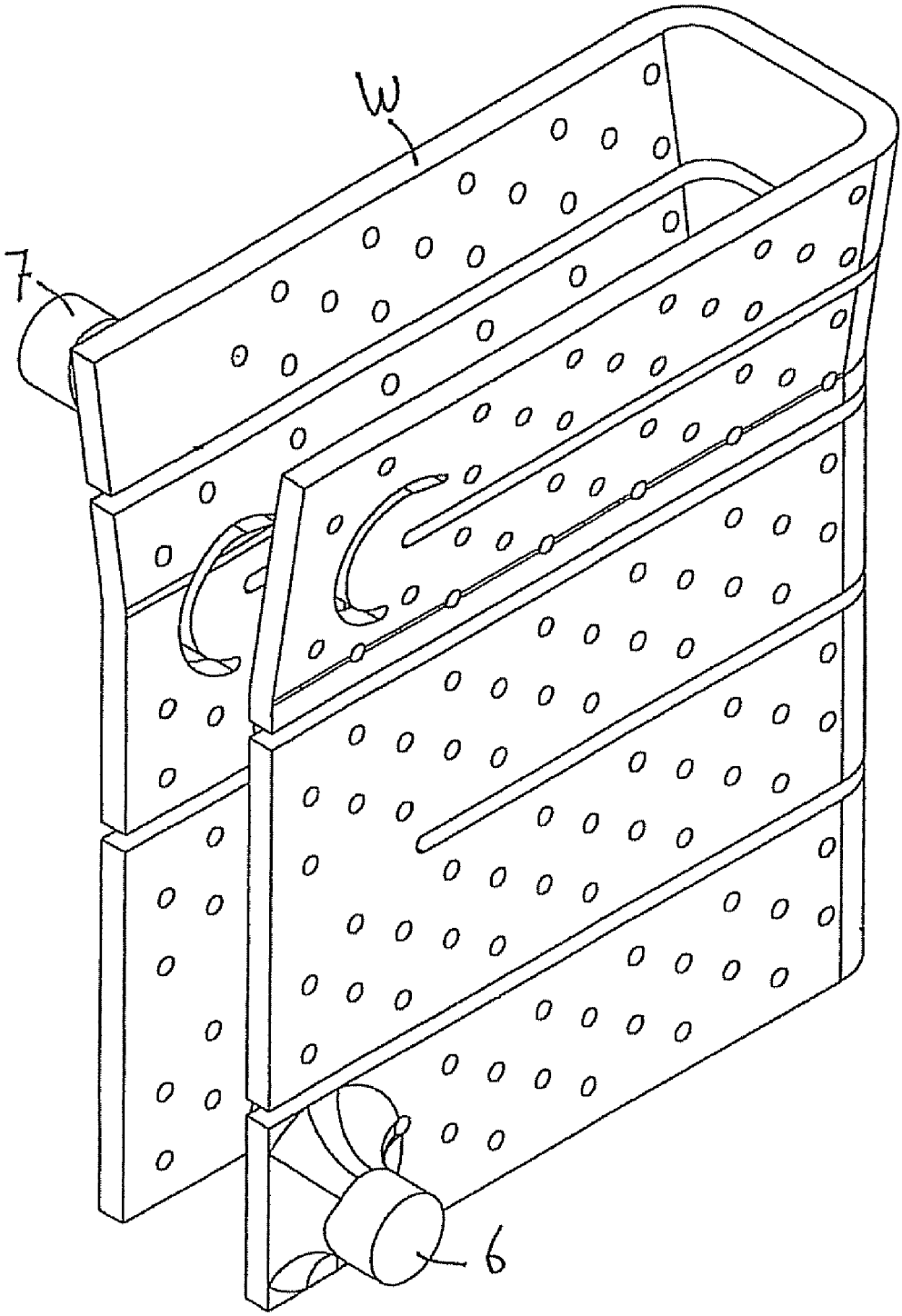
FIG. 3 shows a view of the water-carrying channel.

The exemplary embodiment of a central heating heat exchange element 1 shown in FIGS. 1-3 is a one-piece monocasting formed substantially of aluminum, the description of which corresponds to the heat exchange element disclosed in Dutch patent application No. 1029004, filed on May 10, 2005, the contents of which are incorporated herein by reference in their entirety.

The heat exchange element 1 is provided with a number of walls 2. At least one of these walls 2 bounds a flue gas draft 3, a portion of these walls 2 bound a water-carrying channel 4, and at least one of the walls 2 bounds both the flue gas draft 3 and the water-carrying channel 4—and are therefore water-cooled. A burner 5 (see FIG. 2) is connected to the flue gas draft 3. In the present exemplary embodiment, three of the walls 2 bounding the flue gas draft are water-cooled in that the water-carrying channel 4 extends along these walls. In a horizontal cross-section of the heat exchange element, the water channel has a U-shaped configuration, which is viewable in FIG. 3. The water flows from an inlet 6 to an outlet 7 of the water channel while, each time, traveling a U-shaped path and, thus, flowing in a zigzag manner around the flue gas draft 3 in a upward direction (in the displayed orientation in FIG. 3) from the inlet 6 to the outlet 7.

The walls 2 are provided, on the side of the flue gas draft 3, with heat exchanging surface enlarging pins and/or fins 8. The pins and/or fins 8 have a cross-sectional surface that is smaller than 25 $mm^2$. In the part 3*a* of the flue gas draft where the walls 2 extend parallel to each other, which, in the present exemplary embodiment, is the lower portion, the pins 8 have a length of approximately 15 mm. Preferably, the pins 8 have a cross-sectional surface of 20 $mm^2$ or less. The pins potentially have a circular cross-section with a diameter of approximately 4 mm, a square cross-section, with the sides having a length of approximately 4 mm, or an ellipsoid or fin-shaped cross-section with a mentioned cross-sectional surface. At the location where a burner 5 can be fitted on the heat exchange element 1, which, in the present exemplary embodiment, is the upper side of the heat exchange element 1, the flue gas draft 3 is of widened design for forming a burn out space 3*b* (see FIG. 2). The burn out space 3*b* is very compact and the exemplary embodiment shown is particularly suitable for cooperation with a high-performance burner 5 with a compact burn out space.

In order to prevent the pins 8 from overheating near the free ends thereof, the length of the pins 8 is smaller on an upstream side 3*b* of the flue gas draft 3, to which the burner 5 can be fitted, than the length of the pins 8 on a downstream side 3*a* of the flue gas draft 3. The ends of the relatively short pins 8 are therefore close to the water-carrying channel 4, so that the risk of these ends overheating is reduced to a minimum. Preferably, the length of the 20 pins and/or fins 8 increases in the widened part 3*b* forming the burn out space of the flue gas draft 3, accordingly as the pins and/or fins 8 are arranged further downstream of the burner.

The present exemplary embodiment shows a heat exchange element with an output of approximately 25 kW. Here, the weight of the heat exchange element per kW, to provide the specified output, is less than 0.20 kg/kW. In the present exemplary embodiment, the weight is only 0.16 kg/kW. With a heat exchange element with such an output, the water-carrying channel 4 has a volume smaller than 1 liter. In the present exemplary embodiment, the water volume is even only 0.9 liter. This limited volume is achieved by a heat exchange element wherein the distance between the wall 9, which bounds on the one side the water-carrying channel 4 and on the other side the outside of the heat exchange element 1, and the wall 2, which bounds on the one side the water-carrying channel and on the other side the flue gas draft, is smaller than 10 mm. This distance is preferably smaller than 8 mm.

In the present exemplary embodiment, the flue gases flow from the top to the bottom of the heat exchange element through the flue gas draft 3, and the water to be heated flows from the bottom, via the already described U-shaped zigzag path, to the top.

The heat exchange element 1 is preferably manufactured by means of a casting process, such as, for instance, sand casting or die-casting. Preferably, use is made of one water-side core for forming the water channel and one flue gas side core for forming the flue gas channel. The water side core has substantially a shape as represented in FIG. 3.

In order to form a heating boiler from the heat exchange element 1, a burner 5 is fitted on the heat exchange element. In the exemplary embodiment a high-performance burner 5 is used. The high-performance burner 5 is schematically represented, in part, in FIG. 2. To the underside 3*a* of the flue gas draft, as a general rule, a flue gas discharge is connected, extending in upward direction.

Figure 4:
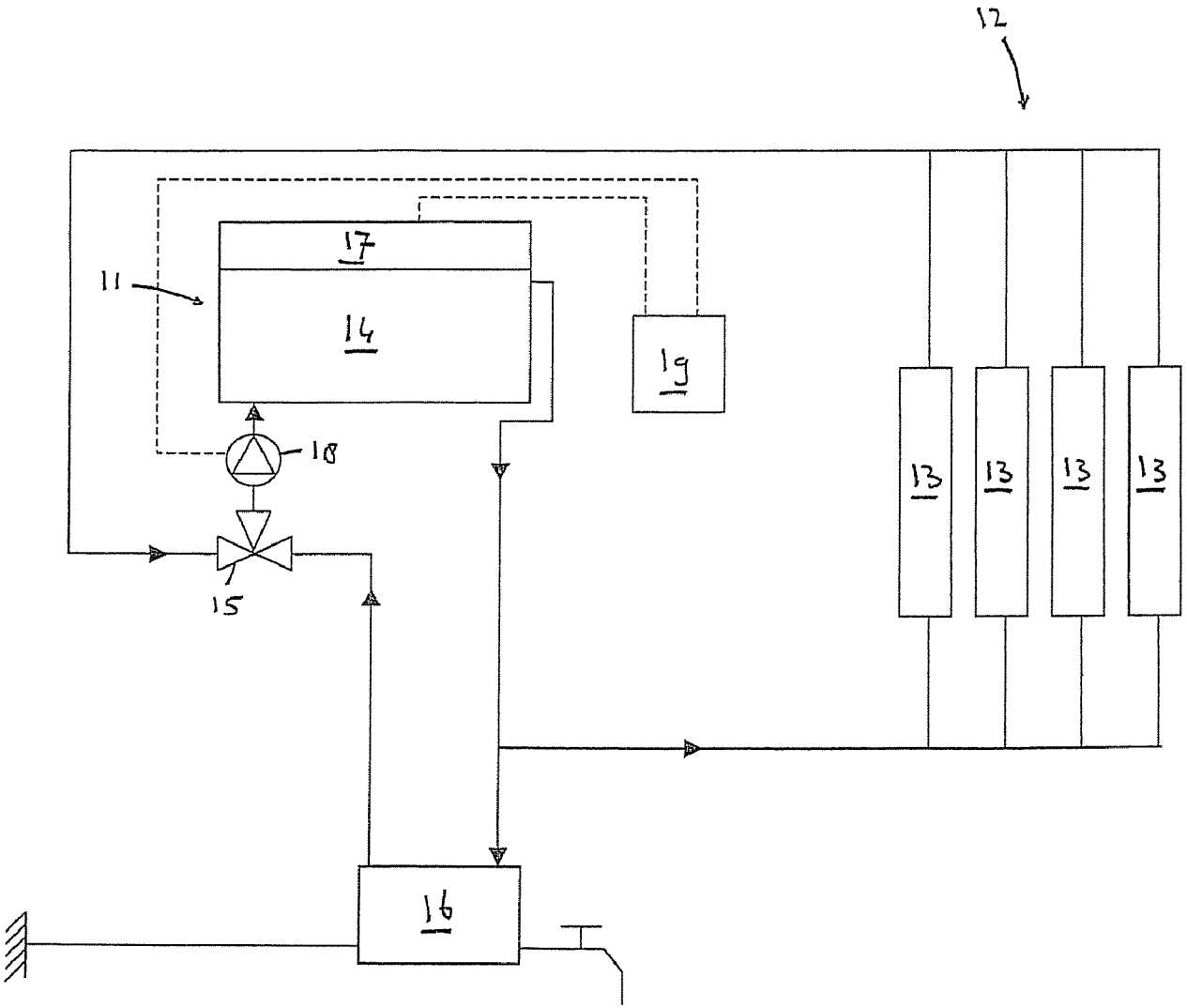
FIG. 4 shows a diagram of a central heating boiler with tap water heat exchanger and central heating water pipe system.

Finally, FIG. 4 schematically depicts an exemplary embodiment of a heating boiler 11 connected to a central heating water pipe system 12. The central heating heat exchange element 14 of the heating boiler 11 is connected, via a valve assembly 15, to a tap water heat exchanger 16. However, also an elaboration with two pumps and a number of check valves as described in EP-A-0 608 030 is a possibility. As, per kW output, the weight of the central heating heat exchange element 14 according to the invention is limited, and as, furthermore, the water content of the water-carrying channel 4 is limited, the heat capacity of the central heating heat exchange element 14 is particularly limited. This leads to a very rapid heating of the heat exchange element 14 when the burner 17 is switched on. In particular with tap water in use, a rapid heating is of importance for realizing a good heating response time to prevent a temperature dip from occurring when tapping hot tap water, and for realizing a high efficiency.

Efficiency is increased by accordingly adjusting the pump 18, which is provided to force water through the central heating heat exchange element 14 and the tap water heat exchanger 16, the central heating heat exchange element 14, the tap water heat exchanger 16, and the burner, in a manner such that the difference between supply water temperature and the return water temperature is greater than 25° C. and, more particularly, greater than 30° C. This is preferably affected by maintaining the central heating side flow rate, i.e. the flow rate in the water-carrying channel of the central heating heat exchange element, low. When the temperature of the supply water that is led from the central heating heat exchange element to the tap water heat exchanger is then in the range of 65 to 90° C., more particularly approximately 70° C., and when, for instance, the return water temperature is approximately 30° C., the average temperature of the central heating heat exchange element is lower than was customary heretofore. Previously, the return water temperature was 50° C., while the supply temperature is approximately 70° C. Due to the lower average temperature in the described system, heating the central heating heat exchange element requires less heat, which, with the tap water in use, results in a rapid response. Due to the low return water temperature, the flue gases can be cooled further, and in a condensing manner, which, with the tap water in use, results in a better efficiency.

As the central heating side flow rate is maintained low, the flow velocity in the water-carrying channel in the central heating heat exchange element is also low. This results in the heat transfer surface on the water-side in the central heating heat exchange element 11 potentially becoming too small. To solve this potential problem, heat exchanging surface enlarging pins 10 are provided in the water-carrying channel 4. Naturally, such waterside pins 10 can also be designed as fins and they can also have, instead of a circular cross-section, a square, rectangular or other cross-section.

It is noted that the great temperature difference between the supply water temperature and return water temperature has the advantages described not only with the heat exchange element, but leads to the described advantages with any type of heating boiler provided with a central heating heat exchange element which can be connected to a tap water heat exchanger. It will be clear that the combination of the new heat exchange element described herein, and an embodiment of a heating boiler with tap water heat exchanger with the great temperature difference between supply water temperature and return water temperature, leads to particularly rapid heating of tap water with tap water in use in combination with a high efficiency heat exchange element.

The invention is not limited to the exemplary embodiment described. In view of the many possible embodiments to which the principles of this invention may be applied, it should be recognized that the embodiments described herein with respect to the drawing figures are meant to be illustrative only and should not be taken as limiting the scope of invention. Therefore, the invention as described herein contemplates all such embodiments as may come within the scope of the following claims and equivalents thereof.

What is claimed is:

1. A heat exchange element for a central heating boiler, which heat exchange element is designed as a substantially aluminum monocasting, the heat exchange element being provided with walls which bound a water-carrying channel, and with at least one wall which bounds at least one flue gas draft to which a burner can be connected, at least one wall which bounds the at least one flue gas draft being water-cooled in that it also forms a boundary of the water-carrying channel, wherein at least one water-cooled wall is provided with heat exchanging surface enlarging pins and/or fins which extend in the respective flue gas draft, characterized in that the cross-sectional surface of ones of the pin and/or fin is smaller than 25 $mm^2$ and, wherein heat exchanging surface enlarging pins and/or fins are arranged in the water-carrying channel, which heat exchanging surface enlarging pins and/or fins arranged in the water-carrying channel each have a base that is connected to the wall which bounds the at least one flue gas draft.

2. The heat exchange element of claim 1, wherein the cross-sectional surface of ones of said pin and/or fin is smaller than 20 $mm^2$.

3. The heat exchange element of claim 1, wherein the pins and/or fins comprise pins having a substantially circular cross-section with a diameter of approximately 4 mm.

4. The heat exchange element of claim 1, wherein the pins and/or fins comprise pins having a substantially square cross-section, the sides of which have a length of approximately 4 mm.

5. The heat exchange element of claim 1, wherein the pins and/or fins have a length of 15 mm or less.

6. The heat exchange element of claim 1, wherein the distance between two opposite walls, which bear pins and/or fins and bound a flue gas draft, is smaller than 35 mm, at least in a downstream portion of the respective flue gas draft.

7. The heat exchange element of claim 1, wherein a flue gas draft is widened on a side to which a burner can be fitted, for forming a compact burn out space, while the heat exchange element is suitable for cooperation with a high-performance burner with a compact burn out space.

8. The heat exchange element according to claim 7, wherein a length of the pins and/or fins in the widened part of the flue gas draft forming the burn out space increases accordingly as the pins and/or fins are arranged further downstream of the burner, while the pins and/or fins in a further downstream part of the flue gas draft have substantially a same length.

9. The heat exchange element of claim 1, wherein the pins and/or fins on an upstream side of a flue gas draft to which a burner can be fitted have a length that is smaller than the length of the pins and/or fins on a downstream side.

10. The heat exchange element of claim 1, wherein volume of the water channel per kW output is smaller than 0.05 l/kW.

11. The heat exchange element of claim 10 wherein volume of the water channel per kW output is smaller than 0.04 l/kW.

12. The heat exchange element of claim 1, wherein weight of the heat exchange element per kW to be provided is less than 0.020 kg/kW.

13. The heat exchange element of claim 12 wherein the weight of the heat exchange element per kW to be provided is less than 0.16 kg/kW.

14. The heat exchange element of claim 1, wherein the distance between the wall which bounds, on the one side, the water-carrying channel and, on the other side, an outside of the heat exchange element, and the wall which bounds, on the one side, the water-carrying channel and, on the other side, the flue gas draft, is smaller than 10 mm.

15. The heat exchange element of claim 14 wherein the distance between the wall which bounds, on the one side, the water-carrying channel and, on the other side, an outside of the heat exchange element, and the wall which bounds, on the one side, the water-carrying channel and, on the other side, the flue gas draft is smaller than 8 mm.

16. The heat exchange element of claim 1, wherein the burner is fitted to a top side of the heat exchange element, wherein the flue gas flow direction is directed from the top to the bottom.

17. The heat exchange element of claim 1, wherein the water-carrying channel is provided with an inlet for water to be heated, the inlet being provided adjacent to the downstream end of the at least one flue gas draft, wherein the water-carrying channel is provided with an outlet for heated water, the outlet being provided adjacent to an upstream end of the at least one flue gas draft.

18. The heat exchange element of claim 1, wherein the exchange element is manufactured by a low pressure casting process, such as for instance sand casting or die-casting.

19. The heat exchange element of claim 1, wherein during casting process, use is made of a water-side core for forming the water channel and a flue gas side core for forming the flue gas channel.

20. A heating boiler comprising:

a heat exchange element for a central heating boiler, which heat exchange element is designed as a substantially aluminum monocasting, the heat exchange element being provided with walls which bound a water-carrying channel, and with at least one wall which bounds at least one flue gas draft to which a burner can be connected, at least one wall which bounds the at least one flue gas draft being water-cooled in that it also forms a boundary of the water-carrying channel, wherein at least one water-cooled wall is provided with heat exchanging surface enlarging pins and/or fins which extend in the respective flue gas draft, characterized in that the cross-sectional surface of ones of the pin and/or fin is smaller than 25 $mm^2$ and, wherein heat exchanging surface enlarging pins and/or fins are arranged in the water-carrying channel, which heat exchanging surface enlarging pins and/or fins arranged in the water-carrying channel each have a base that is connected to the wall which bounds the at least one flue gas draft; and a high-performance burner which is fitted on the heat exchange element.

21. A heating boiler provided with:

a burner; and a central heating heat exchange element with a water-carrying channel, the heating boiler also being provided with a tap water heat exchanger which can be connected to an outlet of the water-carrying channel and an inlet of the water-carrying channel, a pump being provided for transporting the water through the central heating heat exchange element and the tap water heat exchanger, while the central heating heat exchange element, the tap water heat exchanger, the burner, the pump are adjusted to each other such that, with tap water in use, the difference between the temperature of the water coming from the water-carrying channel that is led to the tap water heat exchanger, and the temperature of the water coming from the tap water heat exchanger that is led into the inlet of the water-carrying channel, is greater than 25° C.

22. The heating boiler of claim 21, wherein dimensioning of the central heating heat exchange element and the tap water heat exchanger, and dimensioning or control of the pump is such that the flow rate in the water-carrying channel of the central heating heat exchange element is relatively low, resulting in the greater than 25° C. temperature difference.

23. The heating boiler of claim 21, wherein the temperature of the water coming from the tap water heat exchanger that is led into the inlet of the water-carrying channel with tap water in use is approximately 30° C.

24. The heating boiler of claim 21, wherein the temperature of the water coming from the water-carrying channel that is led to the tap water heat exchanger, with tap water in use, is in the range of 65° C.-90° C.

25. The heating boiler of claim 24 wherein the temperature of the water coming from the water-carrying channel that is led to the tap water heat exchanger, with tap water in use, is approximately 70° C.

26. The heating boiler of claim 21, wherein the flow rate of water provided by the pump is adjustable.

27. The heating boiler of claim 21, wherein the output provided by the burner is adjustable.

28. The heating boiler of claim 21, wherein volume of the central heating heat exchange element is designed as a substantially aluminum monocasting, the heat exchange element being provided with walls which bound a water-carrying channel, and with at least one wall which bounds at least one flue gas draft to which a burner can be connected, at least one wall which bounds the at least one flue gas draft being water-cooled in that it also forms a boundary of the water-carrying channel, wherein at least one water-cooled wall is provided with heat exchanging surface enlarging pins and/or fins which extend in the respective flue gas draft, characterized in that the cross-sectional surface of ones of the pin and/or fin is smaller than 25 $mm^2$.

29. The heating boiler of claim 21 wherein the difference between the temperature of the water coming from the water-carrying channel that is led to the tap water heat exchanger, and the temperature of the water coming from the tap water heat exchanger that is led into the inlet of the water-carrying channel, is greater than 30° C.

* * * * *